US009609414B2

(12) United States Patent
Yang

(10) Patent No.: US 9,609,414 B2
(45) Date of Patent: Mar. 28, 2017

(54) EARPHONE WITH AT LEAST ONE AIR ORIFICE

(71) Applicant: M2 Technology, Inc., New Taipei (TW)

(72) Inventor: Chun-Yao Yang, New Taipei (TW)

(73) Assignee: M2 Technology, Inc., New Taipei (TW)

( * ) Notice: Subject to any disclaimer, the term of this patent is extended or adjusted under 35 U.S.C. 154(b) by 106 days.

(21) Appl. No.: 14/557,639

(22) Filed: Dec. 2, 2014

(65) Prior Publication Data

US 2016/0157004 A1 Jun. 2, 2016

(51) Int. Cl.

| | |
|---|---|
| ***H04R 1/20*** | (2006.01) |
| ***H04R 1/10*** | (2006.01) |
| *H04R 1/28* | (2006.01) |

(52) U.S. Cl.
CPC ..... *H04R 1/1016* (2013.01); *H04R 1/2803* (2013.01)

(58) Field of Classification Search
USPC ..... 381/345
See application file for complete search history.

(56) References Cited

U.S. PATENT DOCUMENTS

| | | | | |
|---|---|---|---|---|
| 9,215,522 | B2 * | 12/2015 | Monahan | H04R 1/1016 |
| 2001/0017926 | A1 * | 8/2001 | Vicamini | H04M 1/05 381/380 |
| 2009/0041281 | A1 * | 2/2009 | Chang | H04R 1/2811 381/345 |
| 2016/0066080 | A1 * | 3/2016 | Kolton | H04R 1/1091 381/380 |

* cited by examiner

*Primary Examiner* — Amir Etesam
(74) *Attorney, Agent, or Firm* — Alan D. Kamrath; Kamrath IP Lawfirm, P.A.

(57) ABSTRACT

An earphone with at least one air orifice contains a body. The body includes at least one slot defined on a rear cap thereof, and each of the at least one slot has at least one air orifice formed therein. Thereby, the air discharges or draws to vibrate the speaker via the at least one air orifice to reduce resistance of the air against the speaker and to enhance tone quality, when the speaker vibrates in a closed space.

12 Claims, 10 Drawing Sheets

EARPHONE WITH AT LEAST ONE AIR ORIFICE

BACKGROUND OF THE INVENTION

Field of the Invention

The present invention relates to an earphone and, more particularly, to an earphone with at least one air orifice.

Description of the Prior Art

A conventional earphone is portable conveniently in daily life and contains a sound guiding tube, a body, and a speaker. The sound guiding tube is connected with the body to form a closed space. However, the speaker vibrates to cause air flow, and the air does not flow smoothly in the closed space to produce resistance against the speaker, thus reducing tone quality.

The present invention has arisen to mitigate and/or obviate the afore-described disadvantages.

SUMMARY OF THE INVENTION

The primary objective of the present invention is to provide an earphone with at least one air orifice in which the at least one air orifice is defined on a body to reduce resistance of air against the speaker and to enhance tone quality.

To obtain the above-mentioned objectives, an earphone with at least one air orifice provided by the present invention contains a body. The body includes at least one slot defined on a rear cap thereof, and each of the at least one slot has at least one air orifice formed therein.

Preferably, a number of the at least one air orifice is more than one.

Preferably, a number of the at least one slot is more than one.

Preferably, each slot has a nameplate groove defined around an outer rim thereof to accommodate a nameplate.

Preferably, the earphone further contains a sound guiding tube and a speaker. The sound guiding tube is connected with the body, and the speaker is disposed in the sound guiding tube. The speaker has a first O ring fitted on a front end thereof and a second O ring fitted on a rear end thereof. The first O ring and the second O ring are defined between the speaker and the sound guiding tube.

Preferably, the earphone further contains a third O ring fitted on the rear end of the speaker, and the third O ring is located inside the second R ring.

Preferably, a diameter of a cross section of the third O ring is less than that of the second O ring.

Thereby, the air discharges or draws to vibrate the speaker via the at least one air orifice to reduce resistance of the air against the speaker and to enhance tone quality, when the speaker vibrates in a closed space.

DETAILED DESCRIPTION OF THE PREFERRED EMBODIMENTS

Figure 1:
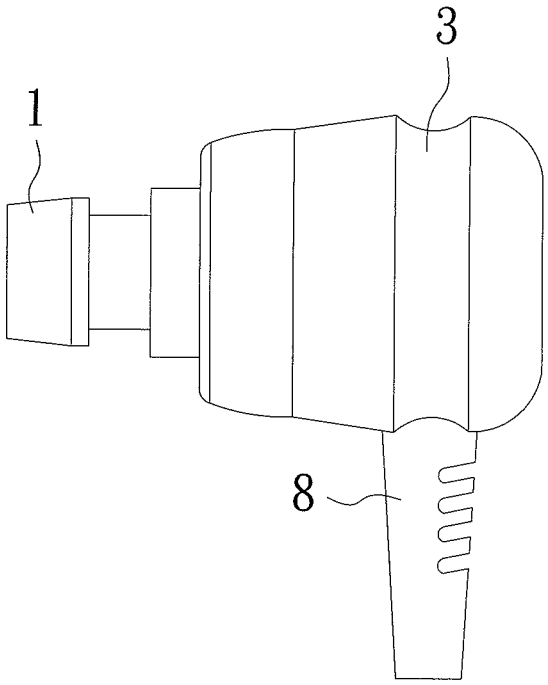
FIG. 1 is a front plan view showing the assembly of an earphone with at least one air orifice according to the present invention.
Figure 2:
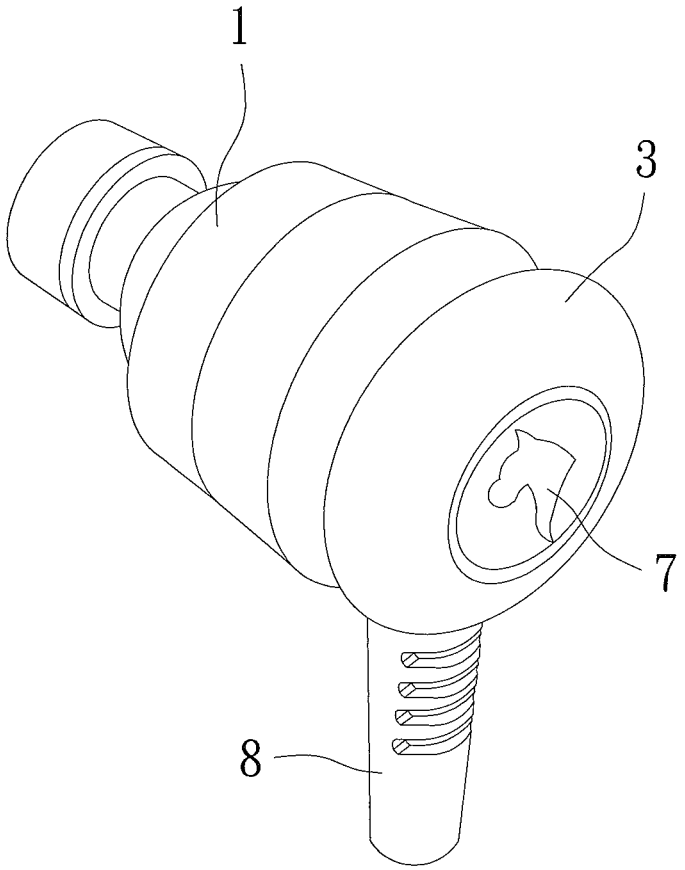
FIG. 2 is a perspective view showing the assembly of the earphone with the at least one air orifice according to the present invention.
Figure 3:
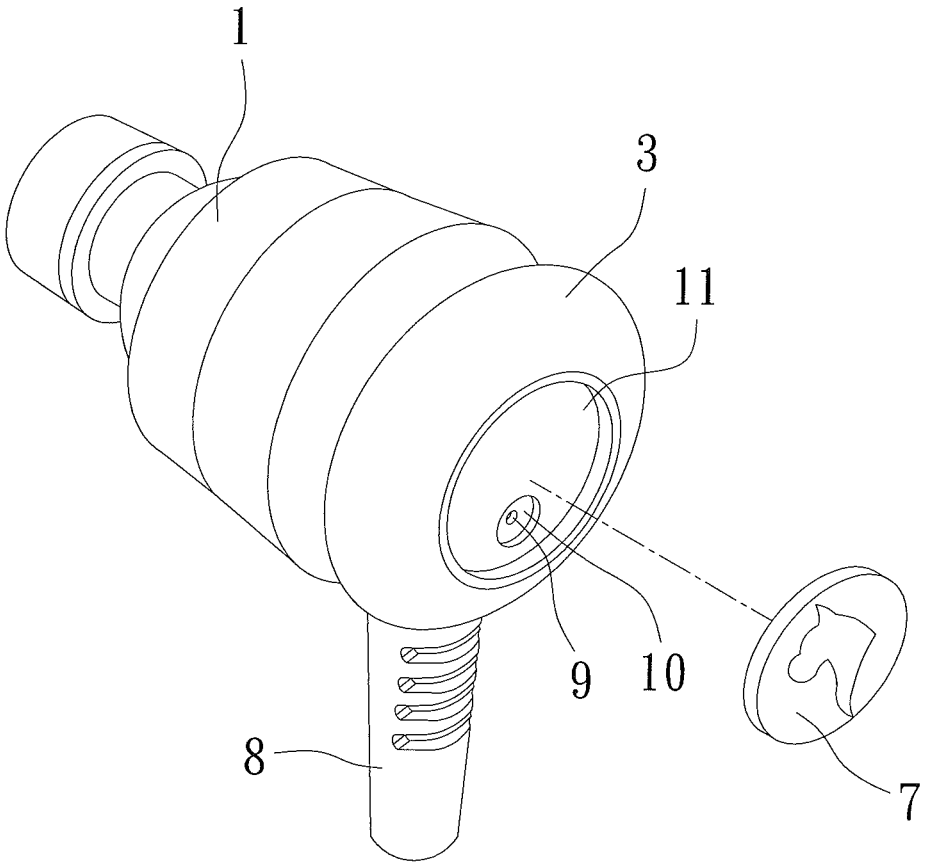
FIG. 3 is a perspective view showing the assembly of a part of the earphone with the at least one air orifice according to the present invention.
Figure 4:
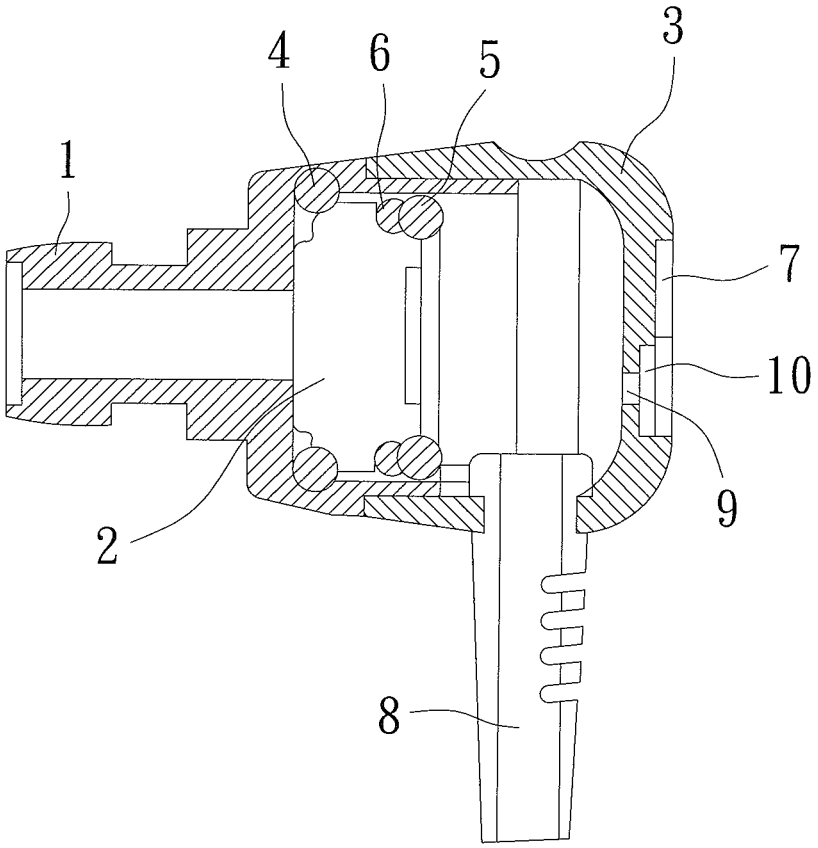
FIG. 4 is a cross sectional view showing the assembly of a part of the earphone with the at least one air orifice according to the present invention.
Figure 5:
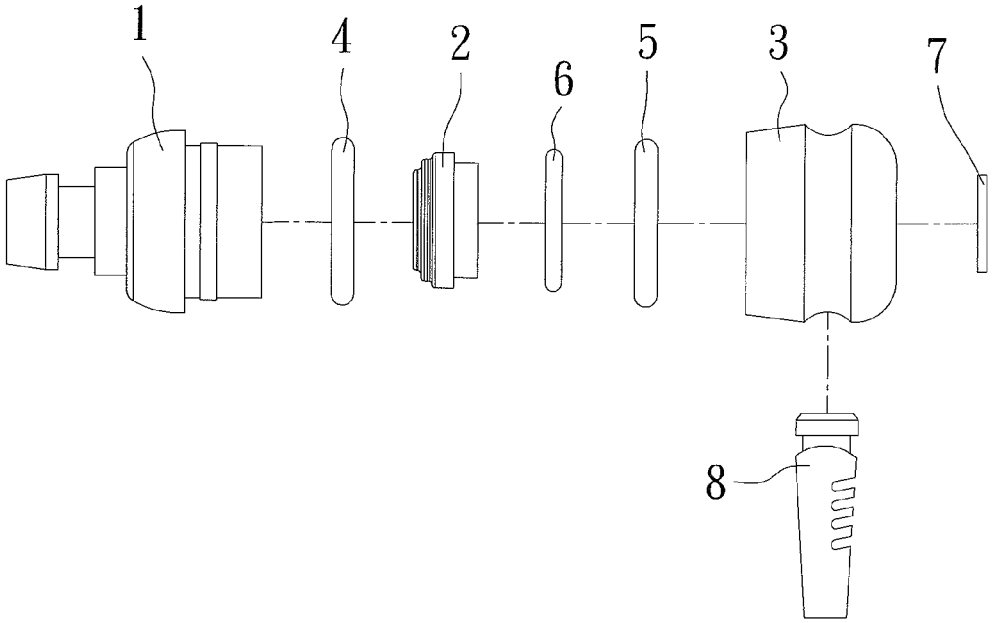
FIG. 5 is a front plan view showing the exploded components of the earphone with the at least one air orifice according to the present invention.
Figure 6:
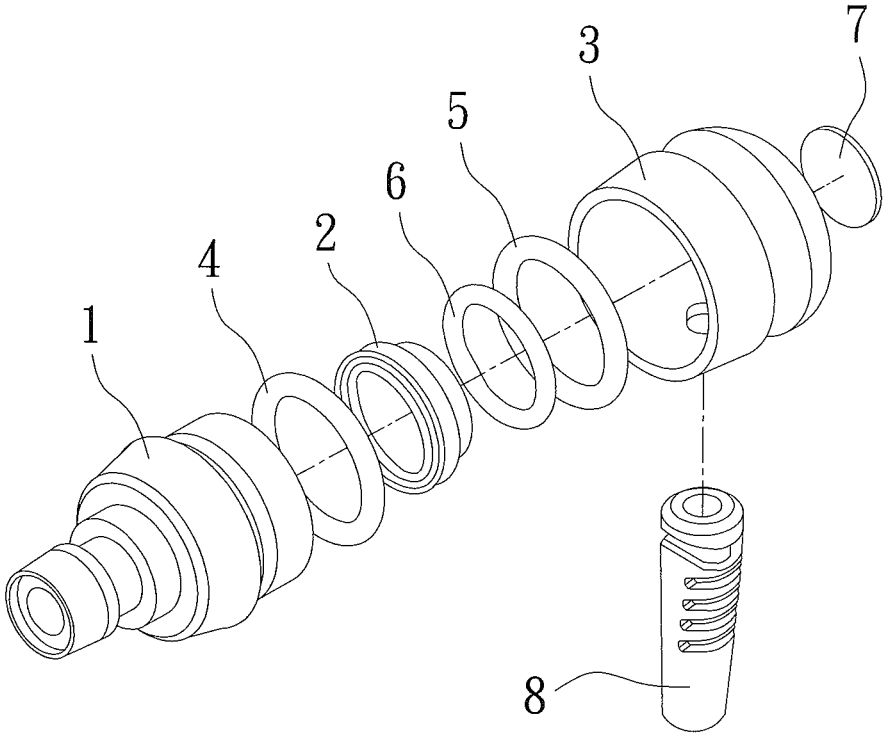
FIG. 6 is a perspective view showing the exploded components of the earphone with the at least one air orifice according to the present invention.
Figure 7:
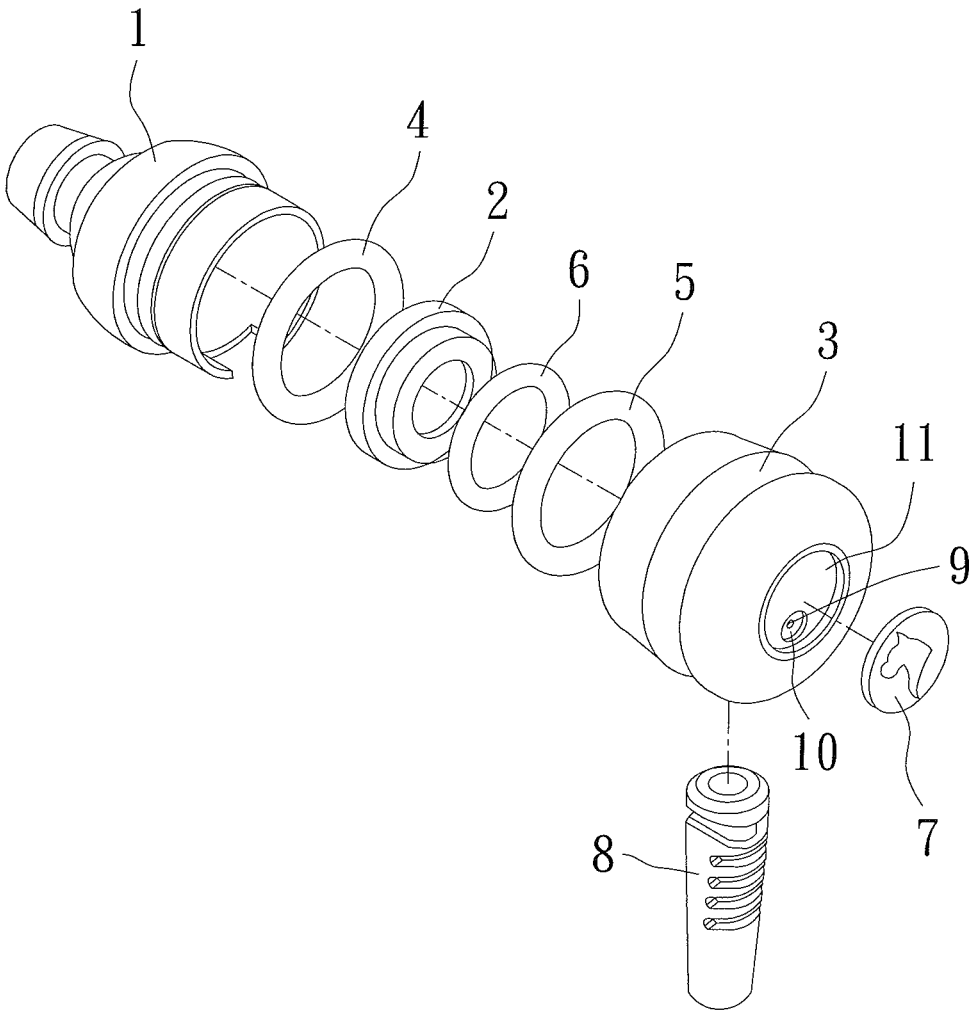
FIG. 7 is another perspective view showing the exploded components of the earphone with the at least one air orifice according to the present invention.

The present invention will be clearer from the following description when viewed together with the accompanying drawings, which show, for purpose of illustration only, preferred embodiments in accordance with the present invention.

With reference to FIGS. 1 to 7, an earphone with at least one air orifice according to a preferred embodiment of the present invention comprises: a sound guiding tube 1, a speaker 2, and a body 3. The sound guiding tube 1 is connected with the body 3 to form an earphone, and the speaker 2 is disposed in the sound guiding tube 1. In this embodiment, the body 3 includes at least one air orifice 9 defined on a rear cap thereof, such that when the speaker 2 vibrates in a closed space, air discharges or draws through the at least one air orifice 9 to reduce resistance of the air against the speaker 2. A number of the at least one air orifice 9 is configured based on using requirements. In this embodiment, each of the at least one air orifice 9 has at least one slot 10 surrounding therearound. A number of the at least one slot 10 is one or more than one, and a shape of each slot 10 is various geometries. Preferably, the shape of each slot 10 is a circle, and one slot 10 surrounds around one air orifice 9. In this embodiment, each slot 10 has a nameplate groove 11 defined around an outer rim thereof to accommodate a nameplate 7, such that the nameplate 7 shields the at least one one air orifice 9.

The one air orifice 9 is embodied in following embodiments.

Figure 8:
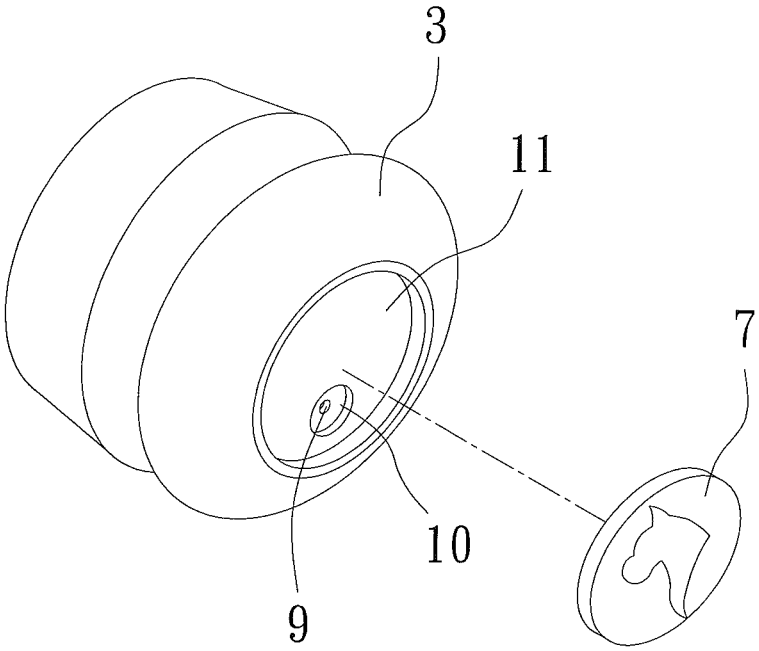
FIG. 8 is a perspective view showing the assembly of a body of the earphone with the at least one air orifice according to a first embodiment of the present invention.

In a first embodiment, as shown in FIG. 8, a diameter of a rear cap of the body 3 is 6.5 mm, and a depth is 0.5 mm of a nameplate groove 11. The nameplate groove 11 has a slot 10 with a diameter of 3 mm and a depth of 0.5 mm, and the slot 10 has a air orifice 9 with a diameter of 1.0 mm. The nameplate groove 11 has a nameplate 7 accommodated therein to shield the air orifice 9.

Figure 9:
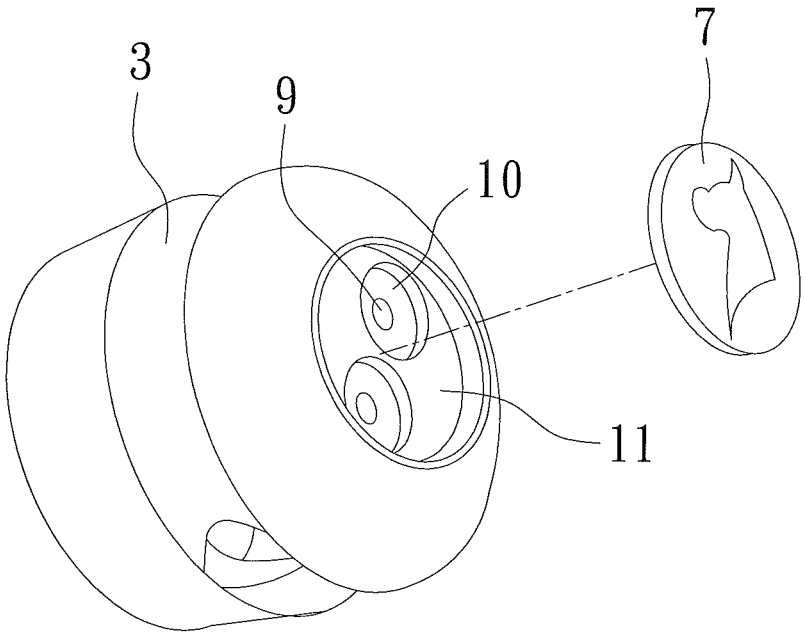
FIG. 9 is a perspective view showing the assembly of a body of the earphone with the at least one air orifice according to a second embodiment of the present invention.

In a second embodiment, as shown in FIG. 9, a diameter of a rear cap of the body 3 is 6.5 mm, and a depth is 0.5 mm of a nameplate groove 11. The nameplate groove 11 has two slots 10, each with a diameter of 3 mm and a depth of 0.5 mm. Each slot 10 has an air orifice 9 with a diameter of 1.0 mm, such that two air orifices 9 are formed on the two slots 10. The nameplate groove 11 has a nameplate 7 accommodated therein to shield the two air orifices 9.

Figure 10:
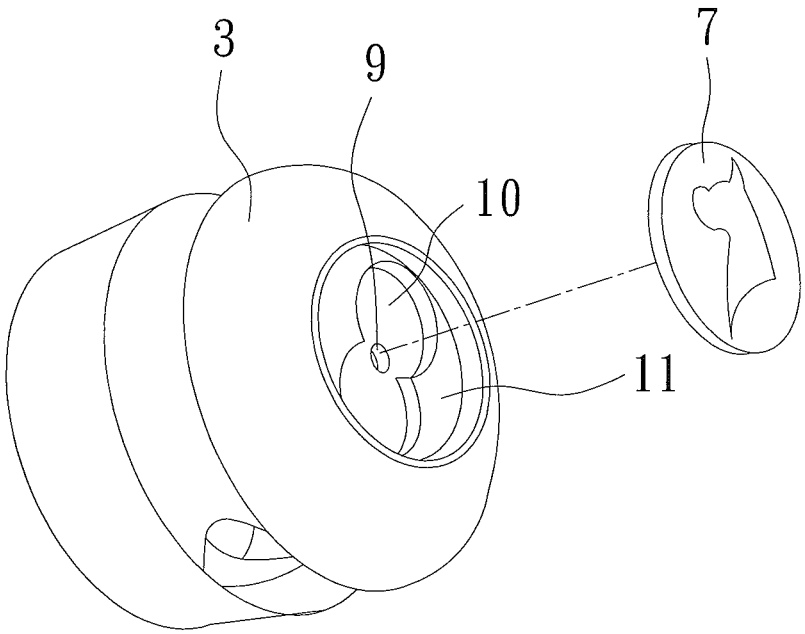
FIG. 10 is a perspective view showing the assembly of a body of the earphone with the at least one air orifice according to a third embodiment of the present invention.

In a third embodiment, as shown in FIG. 10, a diameter of a rear cap of the body 3 is 6.5 mm, and a depth is 0.5 mm of a nameplate groove 11. The nameplate groove 11 has two slots 10, each with a diameter of 3 mm and a depth of 0.5 mm. Each slot 10 has an air orifice 9 with a diameter of 1.0 mm. The two slots 10 are partially crossed to form a 8 shape, and the air orifice 9 is defined on an intermediate position of the two slots 10 and has a diameter of 1.0 mm. The nameplate groove 11 has a nameplate 7 accommodated therein to shield two air orifices 9 of the two slots 10.

In this embodiment, the speaker 2 has a first O ring 4 fitted on a front end thereof and a second O ring 5 fitted on a rear end thereof. The first O ring 4 and the second O ring are defined between the speaker 2 and the sound guiding tube 1 to prevent the speaker 2 from resonance with the sound guiding tube 1 in use. In this embodiment, a third O ring 6 is fitted between the second O ring 5 and the speaker 2 based on using requirements. In addition, a diameter of each of the first O ring 4 and the second O ring 5 is 7 mm, a diameter of a cross section of each of the first O ring 4 and the second O ring 5 is 1.5 mm, a diameter of the third O ring 6 is 7 mm, and a diameter of a cross section of the third O ring 6 is 1.1 mm. Preferably, a size of each of the first O ring 4, the second O ring 5, and the third O ring 6 is configured according to the using requirements. The body 3 also includes a protective sleeve 8 for protecting a connecting wire of the earphone.

In the above three embodiments, the earphone is applicable for a user's right ear. Since other mechanisms of the earphone are a well-known art, further remarks are omitted.

Thereby, the air discharges or draws to vibrate the speaker via the at least one air orifice to reduce resistance of the air against the speaker 2 and to enhance tone quality, when the speaker vibrates in a closed space.

While various embodiments in accordance with the present invention have been shown and described, it is clear to those skilled in the art that further embodiments may be made without departing from the scope of the present invention.

What is claimed is:

1. An earphone comprising:

a body including a hollow interior and a rear cap having an exterior surface;

a nameplate groove defined in the rear cap and extending inwardly of the exterior surface, with the nameplate groove having an outer rim;

a nameplate received in the name plate groove and abutting with the outer rim thereof;

at least one slot defined in the rear cap and extending inwardly of the exterior surface and the nameplate groove; and at least one air orifice formed in the at least one slot and being in air communication with the hollow interior and the at least one name plate groove.

2. The earphone as claimed in claim 1, wherein a number of the at least one air orifice is more than one.

3. The earphone as claimed in claim 1, wherein a number of the at least one slot is more than one.

4. The earphone as claimed in claim 1 further comprising a sound guiding tube and a speaker, wherein the sound guiding tube is connected with the body, wherein the speaker is disposed in the sound guiding tube; wherein the speaker has a first O ring fitted on a front end thereof and a second O ring fitted on a rear end thereof, and wherein the first O ring and the second O ring are defined between the speaker and the sound guiding tube.

5. The earphone as claimed in claim 2 further comprising a sound guiding tube and a speaker, wherein the sound guiding tube is connected with the body, wherein the speaker is disposed in the sound guiding tube; wherein the speaker has a first O ring fitted on a front end thereof and a second O ring fitted on a rear end thereof, and wherein the first O ring and the second O ring are defined between the speaker and the sound guiding tube.

6. The earphone as claimed in claim 3 further comprising a sound guiding tube and a speaker, wherein the sound guiding tube is connected with the body, wherein the speaker is disposed in the sound guiding tube; wherein the speaker has a first O ring fitted on a front end thereof and a second O ring fitted on a rear end thereof, and wherein the first O ring and the second O ring are defined between the speaker and the sound guiding tube.

7. The earphone as claimed in claim 4 further comprising a third O ring fitted on the rear end of the speaker, and the third O ring is located inside the second R ring.

8. The earphone as claimed in claim 5 further comprising a third O ring fitted on the rear end of the speaker, and wherein the third O ring is located inside the second R ring.

9. The earphone as claimed in claim 6 further comprising a third O ring fitted on the rear end of the speaker, and wherein the third O ring is located inside the second R ring.

10. The earphone as claimed in claim 7, wherein a diameter of a cross section of the third O ring is less than that of the second O ring.

11. The earphone as claimed in claim 8, wherein a diameter of a cross section of the third O ring is less than that of the second O ring.

12. The earphone as claimed in claim 9, wherein a diameter of a cross section of the third O ring is less than that of the second O ring.

* * * * *